US011149914B2

(12) United States Patent
Risthaus

(10) Patent No.: US 11,149,914 B2
(45) Date of Patent: Oct. 19, 2021

(54) PLANAR LIGHT GUIDE LIGHTING DEVICE FOR VEHICLES

(71) Applicant: HELLA GmbH & Co. KGaA, Lippstadt (DE)

(72) Inventor: Piet Risthaus, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/785,251

(22) Filed: Feb. 7, 2020

(65) Prior Publication Data

US 2020/0256540 A1 Aug. 13, 2020

(30) Foreign Application Priority Data

Feb. 7, 2019 (DE) ..... 10 2019 103 046.3

(51) Int. Cl.

| | |
|---|---|
| ***F21S 43/239*** | (2018.01) |
| ***F21S 43/249*** | (2018.01) |
| ***F21S 41/24*** | (2018.01) |
| ***F21S 41/32*** | (2018.01) |
| ***F21S 41/143*** | (2018.01) |
| ***F21S 41/151*** | (2018.01) |
| ***F21S 43/15*** | (2018.01) |
| ***F21S 43/241*** | (2018.01) |

(Continued)

(52) U.S. Cl.

CPC ..... *F21S 43/239* (2018.01); *F21S 41/143* (2018.01); *F21S 41/151* (2018.01); *F21S 41/24* (2018.01); *F21S 41/322* (2018.01); *F21S 43/15* (2018.01); *F21S 43/241* (2018.01); *F21S 43/243* (2018.01); *F21S 43/249* (2018.01); *F21S 43/14* (2018.01); *F21W 2102/13* (2018.01)

(58) Field of Classification Search

CPC ..... F21S 41/143; F21S 41/24; F21S 41/322; F21S 43/14; F21S 43/239; F21S 43/249; F21S 43/315

See application file for complete search history.

(56) References Cited

U.S. PATENT DOCUMENTS 6,111,668 A * 8/2000 Seo ..... H04N 1/02855 358/474
7,134,768 B2 * 11/2006 Suzuki ..... B60Q 1/0052 362/241

(Continued)

FOREIGN PATENT DOCUMENTS

| | | | |
|---|---|---|---|
| DE | 10 2011 055 429 | A1 | 5/2013 |
| DE | 10 2018 112 794 | A1 | 12/2019 |
| EP | 2 824 385 | A1 | 1/2015 |

*Primary Examiner* — Rajarshi Chakraborty
*Assistant Examiner* — Michael Chiang
(74) *Attorney, Agent, or Firm* — Muncy, Geissler, Olds & Lowe, P.C.

(57) ABSTRACT

A lighting device for vehicles, having a light source unit containing a plurality of light sources for emitting light and having a planar light guide body associated with the light source unit containing a flat surface portion with at least two opposite flat surfaces extending from a light input side of the flat surface portion to a light output side thereof, wherein the light can be coupled out at a narrow side of the light output side for the generation of a light distribution and comprising a deflection section for the deflection of the light emitted by the light source unit in the direction of the narrow side of the flat surface portion coupling out the light.

11 Claims, 4 Drawing Sheets

(51) Int. Cl.

| | |
|---|---|
| ***F21S 43/243*** | (2018.01) |
| *F21S 43/14* | (2018.01) |
| *F21W 102/13* | (2018.01) |

(56) References Cited

U.S. PATENT DOCUMENTS

| | | | | |
|---|---|---|---|---|
| 10,260,693 | B1 * | 4/2019 | Shih | F21S 43/315 |
| 2005/0162857 | A1 * | 7/2005 | Tsukamoto | F21S 41/322<br>362/509 |
| 2006/0198158 | A1 | 9/2006 | Nagabuchi | |
| 2006/0285347 | A1 * | 12/2006 | Okada | F21S 41/321<br>362/516 |
| 2012/0250308 | A1 * | 10/2012 | Zwak | G02B 6/0018<br>362/235 |
| 2016/0018582 | A1 * | 1/2016 | Fiorentino | G02B 6/002<br>362/609 |
| 2019/0278012 | A1 * | 9/2019 | Jurik | F21V 3/00 |
| 2020/0142278 | A1 * | 5/2020 | Engelen | G02B 6/0066 |

* cited by examiner

PLANAR LIGHT GUIDE LIGHTING DEVICE FOR VEHICLES

This nonprovisional application claims priority under 35 U.S.C. § 119(a) to German Patent Application No. 10 2019 103 046.3, which was filed in Germany on Feb. 7, 2019, and which is herein incorporated by reference.

BACKGROUND OF THE INVENTION

Field of the Invention

The present invention relates to a lighting device for vehicles with a light source unit comprising a plurality of light sources for emitting light and with a planar light guide body associated with the light source unit comprising a flat surface portion having at least two opposite flat surfaces, which extend from a light input side of the flat surface portion to a light output side thereof, wherein the light can be coupled out at a narrow side of the light output side to produce a light distribution and comprising a deflection section for deflecting the light emitted from the light source unit in the direction of the narrow side of the flat surface portion coupling out the light.

Description of the Background Art

From DE 10 2011 055 429 A1, an illumination device for vehicles is known in which a light source unit is associated with a planar light guide body. The planar light guide body has a surface side portion with two opposite flat surfaces and a narrow side on one light output side to which the light is coupled out. This enables a linear light emission, which, for example, can be formed following the contour of an edge of a headlamp. The flat light guide body further includes a deflection section, so that the light emitted from the light source unit in the direction of the narrow side of the flat surface portion coupling out the light is deflected. The deflection section has an ellipsoidal surface, so that light entering in a flat light guide body, transversely to a longitudinal median plane of the latter, can be deflected. In addition, the flat light guide body has a lenticular optical element on one flat surface thereof, by means of which the light coming from the light source unit is parallelized. A disadvantage of the known illumination device is that it is relatively expensive to manufacture. Further, due to the total reflection, light losses occur on the inner sides of the total reflection on the opposite flat surfaces of the planar light guide body.

SUMMARY OF THE INVENTION

It is therefore an object of the present invention to provide a lighting device for vehicles in such a way that light can be emitted with high efficiency along a narrow light output side of a planar light guide body.

To achieve this object, the is characterized in that the deflection section has two total reflection surfaces, which are arranged such that the light deflected by the two total reflection surfaces enters in the light input side of the flat surface portion in such a way that it exits directly to the light output side of the flat surface portion through the latter without any total reflection at the flat surfaces of the flat surface portions.

According to the invention, a deflection section of a planar light guide body has two total reflection surfaces, by means of which light coupled into the light guide body is guided to a light input side of a flat surface portion, so that it subsequently is guided to the light-outcoupling narrow side of the flat surface portion without any total reflection at the flat surfaces of said flat surface portion. Advantageously, thereby a relatively narrow light beam can be formed, which exits with a relatively high lighting efficiency on a narrow light output side of the planar light guide body.

The total reflection surfaces are disposed in a periscopic manner so that the light emitted from the light source transversely offset to an optical axis thereof exits from the deflection section and enters the flat surface portion. Accordingly, the light or the light beam is deflected offset in parallel with the original direction of incidence. The deflection section of the flat light guide body thus effectively replaces a primary optics of the respective light sources. The deflection section leads to a deflection of the light emitted by the respective light source that is optimally adapted to the flat surface portion. Additional primary optics between the light source and the deflection section are not required.

A first total reflection surface of the deflection section intersects an optical axis of the light source and causes a deflection of the light beam emitted from the light source towards the second total reflection surface, which is disposed transversely to the optical axis of the light source and offset in parallel with the first total reflection surface. In conformity with a periscope, the light (light beams) are reflected in each case only once at the first total reflection surface and at the second total reflection surface. Advantageously, a narrow light beam having a relatively high lighting efficiency can be provided.

The optical axis of the light source is arranged to extend parallel to or within a relatively small angular range of a maximum of 5° to a longitudinal median plane of the flat surface portion. The deflection section of the planar light guide body thus causes a substantially transversely offset deflection of the light.

The first total reflection surface is formed to be partially ellipsoidal or partially paraboloid, wherein a front marginal edge of the first total reflection surface facing away from the light source and/or a rear marginal edge of the first total reflection surface facing the light source extends in an arc-shaped manner. The first total reflection surface thus extends directed outwards in a substantially arc-shaped manner, wherein the arc shape runs within the deflection section in the luminous flux direction and/or transverse to the luminous flux direction.

The second total reflection surface is designed as an inwardly curved surface or is formed to be planar in the direction of the light input side of the flat surface portion. The bulges of the first and second total reflection surfaces thus extend in the same direction, wherein the degree of bulge or the degree of curvature of the first total reflection surface is greater than the bulge or curvature of the second total reflection surface.

The deflection section and the flat surface portion are integrally connected. To produce a low beam or partial low beam distribution, the lighting device thus substantially is formed of the light source unit and the sole light guide body.

Several deflection sections can extend in the extension direction of a narrow side of the flat surface portion coupling in the light, wherein each deflection section is associated with a light source. Advantageously, this can ensure an even luminous flux distribution along the narrow light output side.

A deflection section can be provided on both sides of an optical axis of the flat surface portion, wherein the deflection sections in each case have an outer first total reflection surface on a side facing away from each other and a second total reflection surface on a side facing each other. The second total reflection surfaces converge to form an intersecting line, which is depicted as a light/dark boundary by means of a narrow side of the flat surface portion coupling out the light. Advantageously, two light distributions can be produced by this lighting device, for example, a low beam or partial low beam function on the one hand, and a high beam or partial high beam function on the other.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
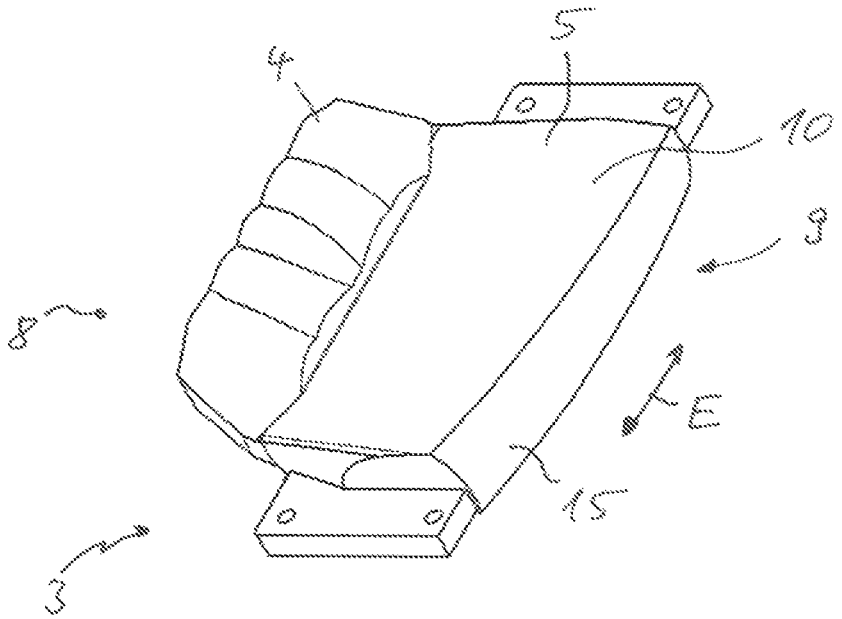
FIG. 1 is a perspective view of the lighting device with two opposite deflection sections and a single flat surface portion.
Figure 2:
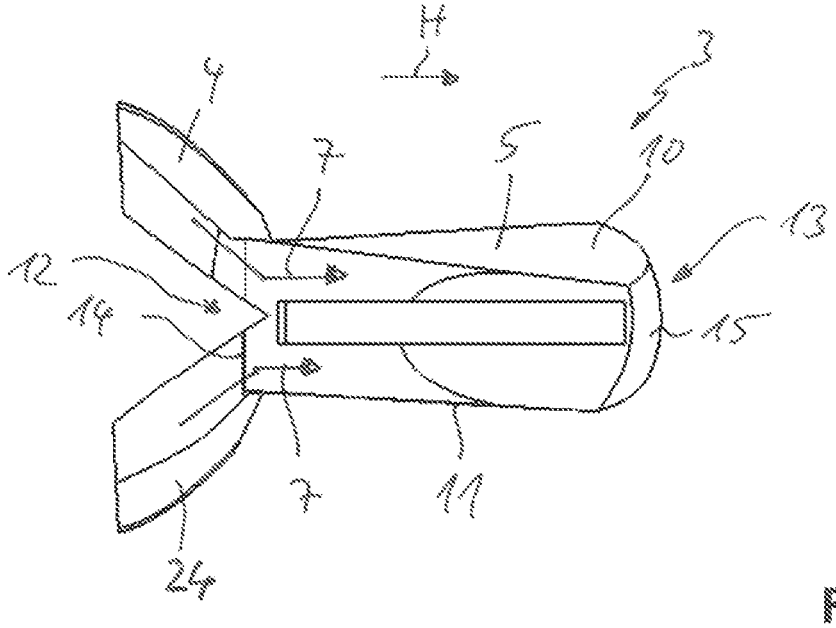
FIG. 2 is a side view of the lighting device according to FIG. 1.
Figure 3:
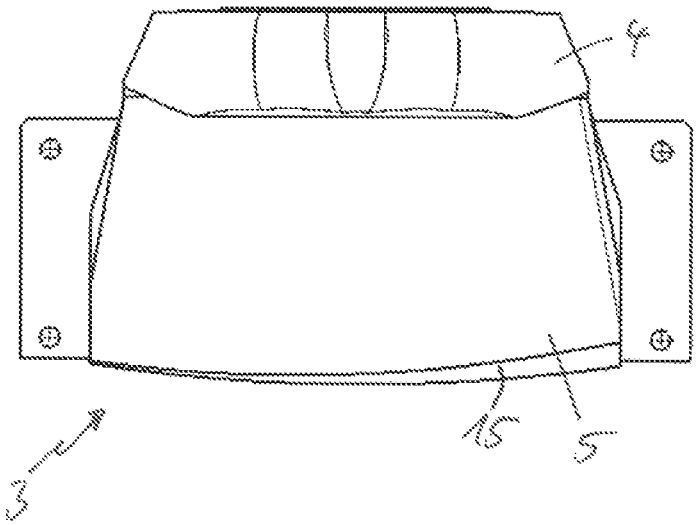
FIG. 3 is a plan view of the lighting device according to FIG. 1.
Figure 4:
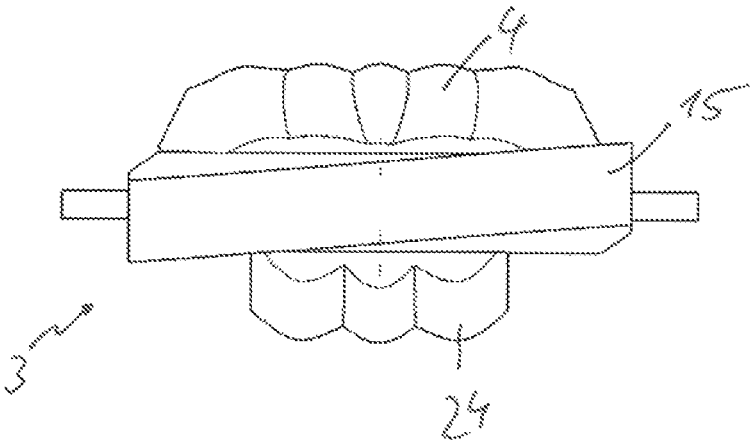
FIG. 4 is a front view of the lighting device according to FIG. 1.
Figure 5:
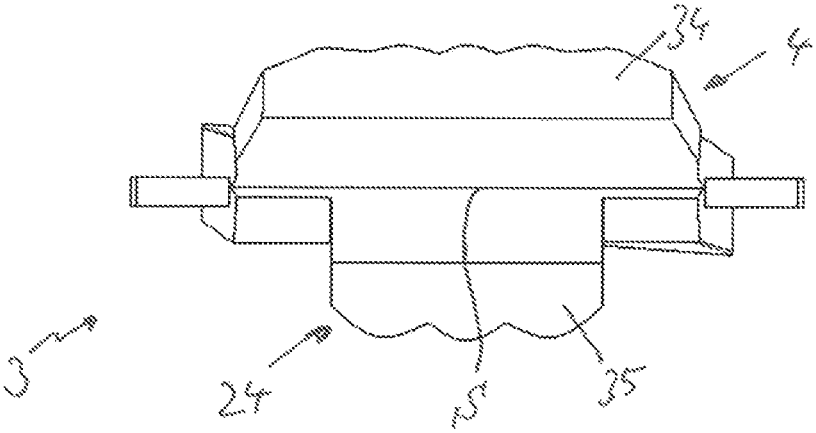
FIG. 5 is a rear view of the lighting device according to FIG. 1.
Figure 6:
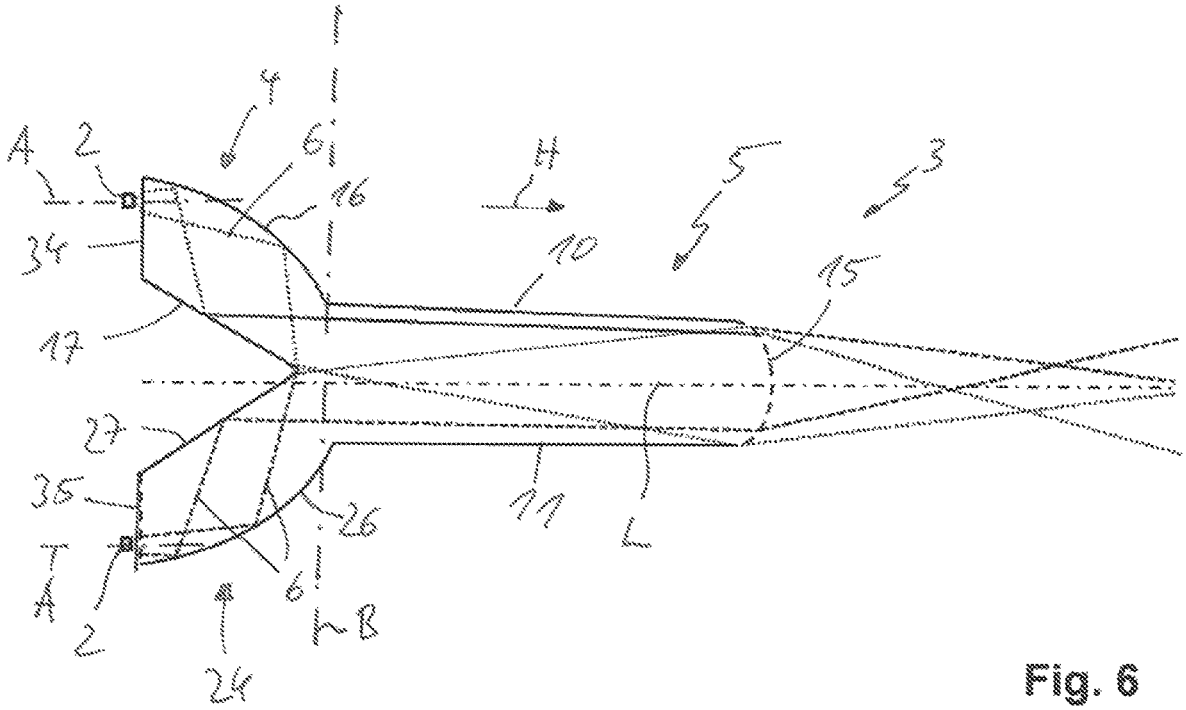
FIG. 6 is a schematic side view of the lighting device according to FIG. 1.
Figure 7:
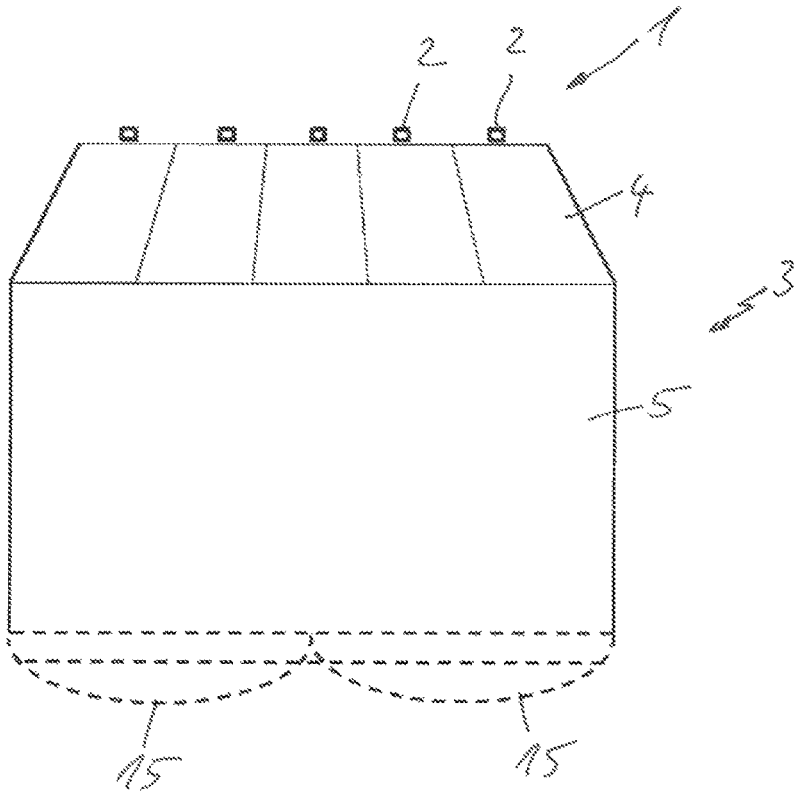
FIG. 7 is a schematic plan view of the lighting device according to FIG. 1.

A lighting device for vehicles according to the invention is used to generate an apron light distribution. The lighting device may be integrated in a headlamp for generating, for example, a low and/or high beam function (embodiment according to FIG. 1 to FIG. 7) or a daytime running light function (embodiment according to FIG. 8). The lighting device essentially comprises a light source unit 1 with a plurality of light sources 2 and a planar light guide body 3.

In the present exemplary embodiment, the light sources 2 extend in rows, i.e., along a straight line. Alternatively, the light sources 2 can also be arranged along an arc and/or extending in several directions.

According to a preferred embodiment of the invention according to FIGS. 1 to 7, the planar light guide body 3 has two deflection sections 4, 24 and a flat surface portion 5 on a side facing the light sources 2. A first deflection section 4 is arranged above an optical axis L of the flat surface portion 5. A second deflection section 24 is arranged below the optical axis L of the flat surface portion 5. The first deflection section 4 and the second deflection section 5 converge on a side facing away from the light source unit 1 to a light input side 12 of the flat surface portion 5. The flat surface portion 5 has two opposite flat surfaces 10, 11 extending from the light input side 12 of the flat surface portion 5 to a light output side 13 of the same. Both the light input side 12 as well as the light output side 13 of the flat surface portion 5 are formed as narrow sides 14 and 15. The flat surfaces 10, 11 run essentially parallel to one another or at a small angle of a small degree.

The light 6 emitted from the light sources 2 of the light source unit 1 is guided by the deflection sections 4, 24 and by the flat surface portion 5 along a luminous flux direction, namely from a light input 8 of the respective deflection section 4, 24 to a light output 9 of the flat surface portion 5.

The deflection sections 4, 24 respectively serve for the deflection of the light 6 emitted from the light source unit 1 in the direction of a narrow side 14 at the light input side 12 of the flat surface portion 5 or in the direction of the narrow side 15 at the light output side 13 of the flat surface portion 5.

The first deflection section 4 and the second deflection section 24 each comprise two total reflection surfaces 16, 17 and 26, 27 arranged in a periscopic manner. The two total reflection surfaces 16, 17 and 26, 27 are formed as twin deflection sections or TIR surfaces. The deflection sections 4 and 24 can be referred to as twin deflection sections, respectively, since they each comprise exactly the two total reflection surfaces 16, 17 and 26, 27.

An outer first total reflection surface 16 of the first deflection section 4 and an outer first total reflection surface 26 of the second deflection section 24 is assigned to the light source 2 and serves as a deflection section on which the light emitted by the light source 2 is deflected for the first time.

An inner second total reflection surface 17 of the first deflection section 4 and an inner second total reflection surface 27 of the second deflection section 24 is offset in parallel with the outer first total reflection surface 16 and the outer second total reflection surface 26, namely preferably at a greater distance to the light source 2 than the corresponding outer first total reflection surface 16, 26 of the first deflection section 4 or the second deflection section 24. The inner second total reflection surface 17, 27 of the first deflection section 4 or the second deflection section 24 serves as a deflection surface at which the light 6 emitted from the light source 2 is deflected for the second time.

The outer first total reflection surface 16 of the first deflection section 4 and the outer first total reflection surface 26 of the second deflection section 24 intersects an optical axis A of the respective associated light source 2. It is formed such that the light beam 6 emitted from the light source 2 is detected and deflected in the direction of the inner second total reflection surface 17 of the first deflection section 4 or the inner second total reflection surface 27 of the second deflection section 24.

The inner second total reflection surface 17 of the first deflection section 4 and the inner second total reflection surface 27 of the second deflection section 24 are each formed such that the light beam 6 incident on it, coming from the outer first total reflection surface 16 of the first deflection section 4 and the outer first total reflection surface 26 of the second deflection section 24, is deflected in the direction of the light input side 12 of the flat surface portion 5.

The light source axis A of the light source 2 in the present embodiment is arranged offset in parallel with the optical axis L of the flat surface portion 5. According to an alternative embodiment, not shown, the light source axis A of the light source 2 can also be arranged offset at an angle of a maximum of 5° to the optical axis L of the flat surface portion 5.

A light input surface 34 of the first deflection section 4 and a light output surface 35 of the second deflection section 24 is preferably formed in a planar or slightly curved manner. A length of the outer first total reflection surface 16, 26 extending from the light input surface 34 of the first deflection section 4 to the narrow side 14 of the flat surface portion 5 and a length of the outer first total reflection surface 16, 26 extending from the light input surface 35 of the second deflection section 24 to the narrow side 14 of the flat surface portion 5 is a function of the light beam angle (opening angle) of the respectively assigned light source 2. The greater the length of the outer first total reflection surface 16, 26, the more light 6 can be "captured" from the light source 2.

The first and second deflection section 4, 24 are respectively integrally connected with the flat surface portion 5.

The outer first total reflection surface 16, 26 of the first deflection section 4 and the second deflection section 24 are each formed partially ellipsoidal and/or partially paraboloid. The outer first total reflection surface 16, 26 thus extends outwardly arched, i.e., curved away from the inner second total reflection surface 17, 27. The outer first total reflection surface 16 of the first deflection section 4 and the outer first total reflection surface 26 of the second deflection section 24 are thus formed to be segmented with a number of segments, each formed to be partially ellipsoidal or partially paraboloid.

The segments of the deflection section 4 and 24 extend spaced apart from each other in the extension direction (E) of the narrow side 14 of the flat surface portion 5. The segments of the first deflection section 4 and the second deflection section 24 are each connected integrally with one another. The extension direction E of the narrow side 14, 15 of the flat surface portion 5 extends in a horizontal plane. The same applies to the longitudinal median plane L.

The inner second total reflection surface 17 of the first deflection section 4 and the inner second total reflection surface 27 of the second deflection section 24 are each designed as planar surfaces or as an inwardly curved surfaces, i.e., curved in the direction of the outer first total reflection surface 16, 26.

The inner second total reflection surface 17 of the first deflection section 4 and the inner second total reflection surface 27 of the second deflection section 24 converge to a common intersecting line S extending in the direction of extension of the narrow side 14 or 15 of the flat surface portion 5. The intersecting line S is shown by means of the narrow side 15 of the flat surface portion 5 that couples out the light as a light/dark boundary of the light distribution. The intersecting line S is located in the vicinity or in the main emission direction H of the lighting device behind an imaging plane B. The imaging plane B extends along the narrow side 14 of the flat surface portion 5 to which the light from the deflection sections 4, 24 is coupled into the flat surface portion 5. By means of a cylindrical or aspherical light output surface 15, the light 6 of the imaging plane B is mapped to the street field.

The light 6 guided through the first deflection section 4 and the flat surface portion 5 serve to generate a low beam or partial low beam function. The light 6 guided through the second deflection section 24 and the flat surface portion 5 are used to generate a high beam or partial high beam function. This is done, of course, as a function of the switched-on or switched-off state of the light sources 2 of light source unit 1 each assigned to the first deflection section 4 and the second deflection section 24.

The number of segments of the first deflection section 4 or the second deflection section 24 corresponds to the number of the light sources 2 respectively associated therewith.

The flat surface portion 5 is essentially cuboid.

The light sources 2 are each formed as LED light sources, which are arranged on a common, level support plate 12, not shown.

Figure 8:
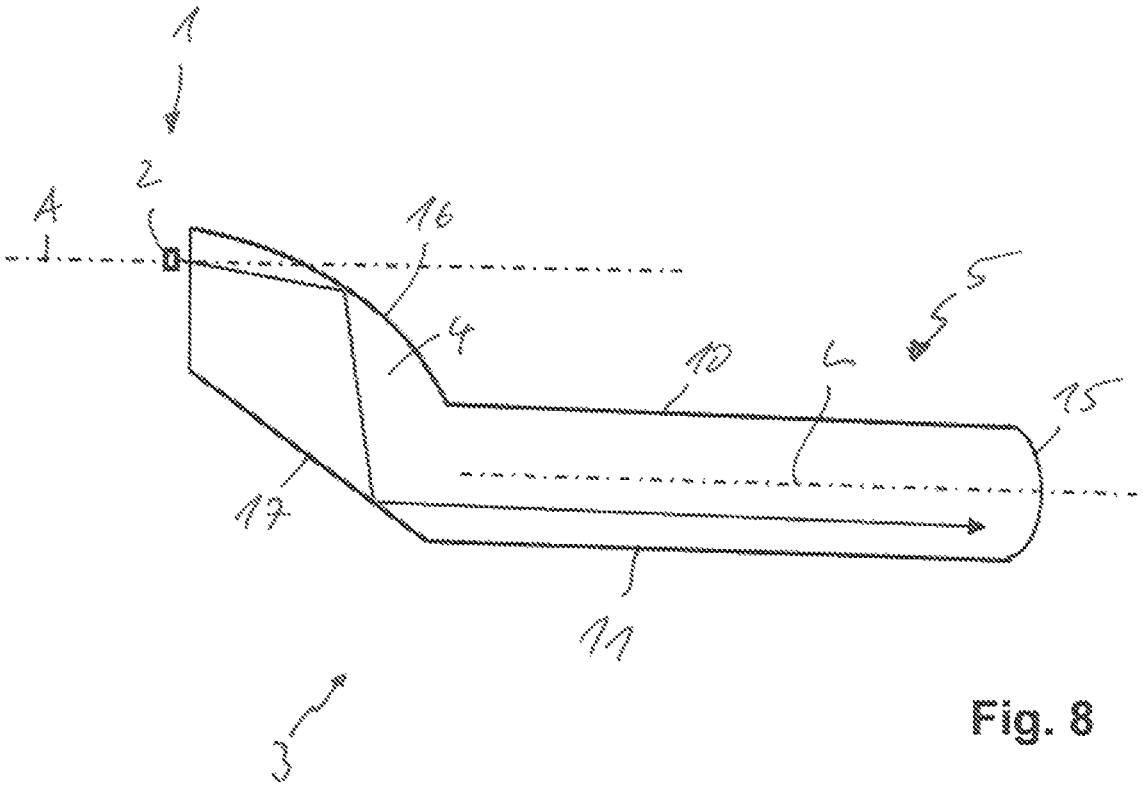
FIG. 8 is a schematic side view of a lighting device with only a single deflection section according to an alternative embodiment of the invention.

According to an alternative embodiment of the invention according to FIG. 8, no double deflection sections 4 and 24 are provided, but rather only a single deflection section 4 (single-leaf). The deflection section 4 substantially corresponds to the upper first deflection section 4 in accordance with embodiments 1 to 7. The deflection section 4 has a first total reflection surface 16 and a second total reflection surface 17. The difference from the first embodiment according to FIGS. 1 to 7 is that the second total reflection surface 17 extends up to the other flat surface 11 of the flat surface portion 5. In accordance with the total reflection surface 4 of the embodiment according to FIGS. 1 to 7, the first total reflection surface 16 of the deflection section 4 extends to the one flat surface 10.

The surface portion 5 and more than two deflection sections, preferably an even number of deflection sections, can be assigned.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lighting device for vehicles, the lighting device comprising:

a light source unit having at least two light sources for emitting light; and a planar light guide body associated with the light source unit comprising a deflection section and a flat surface portion having at least two opposite flat surfaces extending from a light input side of the flat surface portion to a light output side thereof, wherein the light is coupled out at a narrow side of the light output side to produce a light distribution and the light emitted by the light source unit is deflected by the deflection section in the direction of the narrow side of the flat surface portion coupling out the light, wherein the deflection section has two total reflection surfaces, which are arranged such that the light deflected by the two total reflection surfaces enters the light input side of the flat surface portion such that the light passes through the flat surface portion directly to the light output side of the flat surface portion without total reflection at the two opposite flat surfaces of the flat surface portion, wherein the deflection section includes a first deflection section and a second deflection section each having the two total reflection surfaces, wherein the first deflection section is provided on an opposite side of an optical axis of the flat surface portion from the second deflection section, and wherein the flat surface portion is twisted.

2. The lighting device according to claim 1, wherein the two total reflection surfaces are arranged in a periscopic manner, so that the light emitted from the at least two light sources exits from the deflection section and enters in the flat surface portion transversely offset to a light source axis of the at least two light sources.

3. The lighting device according to claim 2, wherein each of the two total reflection surfaces include a first total reflection surface and a second total reflection surface, wherein the first total reflection surface intersects the light source axis and is formed such that the light incident thereon is reflected in the direction of the second total reflection surface, and wherein the second total reflection surface is substantially arranged transversely offset to the light source axis and spaced at a distance from the first total reflection surface.

4. The lighting device according to claim 3, wherein the second total reflection surface is formed such that the light incident thereon is deflected in the direction of the light input side of the flat surface portion.

5. The lighting device according to claim 3, wherein the first total reflection surface is formed segmented as a number of partially ellipsoid or partially paraboloid segments, which extend next to each other along the light input side of the flat surface portion.

6. The lighting device according to claim 3, wherein the second total reflection surface extends as an inwardly curved surface or runs in a planar manner in the direction of the flat surface portion.

7. The lighting device according to claim 2, wherein the light source axis of the at least two light sources extends in parallel with or at an acute angle in the range of zero to a maximum of 5° to an optical axis of the flat surface portion.

8. The lighting device according to claim 1, wherein the deflection section and the flat surface portion are integrally connected.

9. The lighting device according to claim 1, wherein the deflection section is formed of a plurality of segments, wherein the plurality of segments of the deflection section are arranged in an extension direction of a narrow side of the flat surface portion coupling in the light and/or the narrow side of the flat surface portion coupling out the light.

10. The lighting device according to claim 1, wherein the narrow side of the flat surface portion coupling out the light is an imaging surface having a plurality of cylindrical or aspherical surfaces.

11. The lighting device according to claim 1, wherein the first deflection section and the second deflection section each comprise an outer first total reflection surface and an inner second total reflection surface, and wherein the second total reflection surfaces of the first and second deflection section converge to an intersecting line extending in the extension direction of the narrow side of the flat surface portion coupling out the light, the intersecting line being depicted as a light/dark boundary via the narrow side of the flat surface portion coupling out the light.

* * * * *